US007978140B2

(12) United States Patent
Wong et al.

(10) Patent No.: US 7,978,140 B2
(45) Date of Patent: Jul. 12, 2011

(54) MULTIBAND ANTENNA AND COMMUNICATION DEVICE HAVING THE SAME

(75) Inventors: Kin-Lu Wong, Tapei Hsien (TW); Ting-Wei Kang, Taipei Hsien (TW)

(73) Assignee: Acer Inc., Taipei Hsien (TW)

( * ) Notice: Subject to any disclaimer, the term of this patent is extended or adjusted under 35 U.S.C. 154(b) by 240 days.

(21) Appl. No.: 12/468,933

(22) Filed: May 20, 2009

(65) Prior Publication Data

US 2010/0214179 A1 Aug. 26, 2010

(30) Foreign Application Priority Data

Feb. 23, 2009 (TW) ..... 98105708 A

(51) Int. Cl.
*H01Q 1/24* (2006.01)

(52) U.S. Cl. ..... 343/702

(58) Field of Classification Search ..... 343/702, 343/700 MS, 767, 846, 741–744
See application file for complete search history.

(56) References Cited

U.S. PATENT DOCUMENTS 6,466,176 B1 * 10/2002 Maoz et al. ..... 343/767
7,215,283 B2 * 5/2007 Boyle ..... 343/700 MS
7,436,360 B2 * 10/2008 Chen et al. ..... 343/700 MS
7,808,433 B2 * 10/2010 Rutfors et al. ..... 343/700 MS
7,825,863 B2 * 11/2010 Martiskainen et al. ..... 343/702
2005/0264455 A1 * 12/2005 Talvitie et al. ..... 343/702

FOREIGN PATENT DOCUMENTS

TW I258891 4/1994
TW I262620 12/1994

* cited by examiner

*Primary Examiner* — Huedung Mancuso
(74) *Attorney, Agent, or Firm* — Alan Kamrath; Kamrath & Associates PA

(57) ABSTRACT

A multiband antenna for a communication device is disclosed. The multiband antenna comprises a dielectric substrate, a ground portion, and a radiating metal portion. The dielectric substrate comprises two surfaces. The ground portion comprises a first ground plane, a second ground plane, and a connecting metal strip. The first ground plane is on one of the surfaces of the dielectric substrate and has a first connecting point and a shorting point. The second ground plane is near the first ground plane and has a second connecting point. At least one part of the connecting metal strip is on one surface of the dielectric substrate. The connecting metal strip has one end connected to the first connecting point and the other end connected to the second connecting point. The radiating metal portion is connected to the dielectric substrate, without overlapping the first ground plane. The radiating metal portion comprises a radiating section having one end connected to the shorting point and the other end as an open end; and a feeding section having one end connected to a signal source and the other end as an open end, wherein the open end of the feeding section has a spacing of less than 3 mm to the radiating portion.

20 Claims, 7 Drawing Sheets

2A

MULTIBAND ANTENNA AND COMMUNICATION DEVICE HAVING THE SAME

BACKGROUND OF THE INVENTION

1. Field of the Invention

The present invention relates to an antenna and a communication device having the same, and more particularly, to a small-size multiband antenna suitable for a folder type communication device and a folder type communication device having the same.

2. Description of the Related Art

As wireless communication technologies prevail, various wireless communication applications emerge, along with important issues such as antenna miniaturization for portable communication devices. Commonly, it is necessary for most portable communication devices to achieve multiband operations; however, most portable communication devices achieve multiband operations by exciting resonant modes of their embedded antennas only; therefore, in order to cover operations in low-frequency bands, it is often required to increase the occupied area or volume of the antenna.

In prior art techniques such as those disclosed in Taiwan Patent Publication I258,891, entitled "Mobile Phone Antenna," and Taiwan Patent Publication I262,620, entitled "An Internal Mobile Phone Antenna," the planar inverted-F antennas (PIFAs) are designed for application in the folder-type mobile phones, and only the quarter-wavelength resonant modes of the planar inverted-F antennas are excited to cover the required frequency bands. Therefore, the length of the antenna must be extended, resulting in the increase in the occupied area or volume of the antenna.

Hence, it is necessary to provide a multiband antenna and a communication device having the same, which can excite resonant modes contributed by a ground portion of a portable communication device to incorporate the resonant modes of antenna to cover required multiband operations to improve the deficiencies in the prior art technique.

SUMMARY OF THE INVENTION

It is an object of the present invention to provide a multiband antenna which has a miniaturized size and can cover multiband operations to achieve mobile communication capabilities.

It is another object of the present invention to provide a communication device having the multiband antenna as described above.

In order to achieve the above object, the present invention discloses a multiband antenna comprising a dielectric substrate, a ground portion, and a radiating metal portion. The dielectric substrate comprises two surfaces. The ground portion comprises a first ground plane, a second ground plane, and a connecting metal strip. The first ground plane is on one of the surfaces of the dielectric substrate and has a first connecting point and a shorting point. The second ground plane is near the first ground plane and has a second connecting point. At least one part of the connecting metal strip is on one surface of the dielectric substrate. The connecting metal strip has one end connected to the first connecting point and the other end connected to the second connecting point. The radiating metal portion is on the dielectric substrate, without overlapping the first ground plane. The radiating metal portion comprises a radiating section having one end connected to the shorting point and the other end as an open end; and a feeding section having one end connected to a signal source and the other end as an open end, wherein the open end of the feeding section has a spacing of less than 3 mm to the radiating portion.

Hence, the present invention provides a multiband antenna with an innovative structure for various wireless communication applications

DETAILED DESCRIPTION OF THE PREFERRED EMBODIMENT

The advantages and innovative features of the invention will become more apparent from the following detailed description when taken in conjunction with the accompanying drawings.

Figure 1:
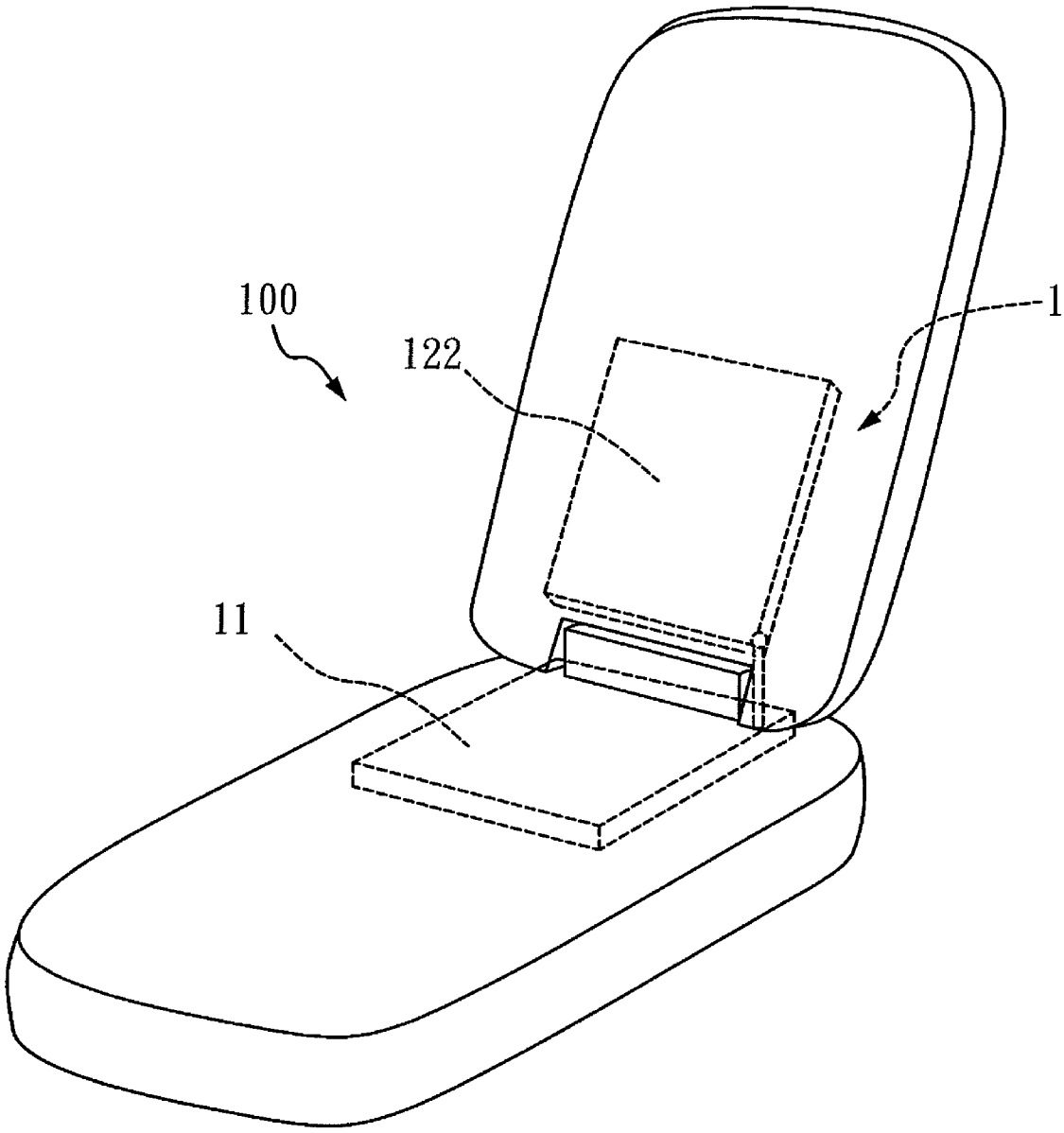
FIG. 1 illustrates a view of a communication device in one embodiment of the present invention.
Figure 2:
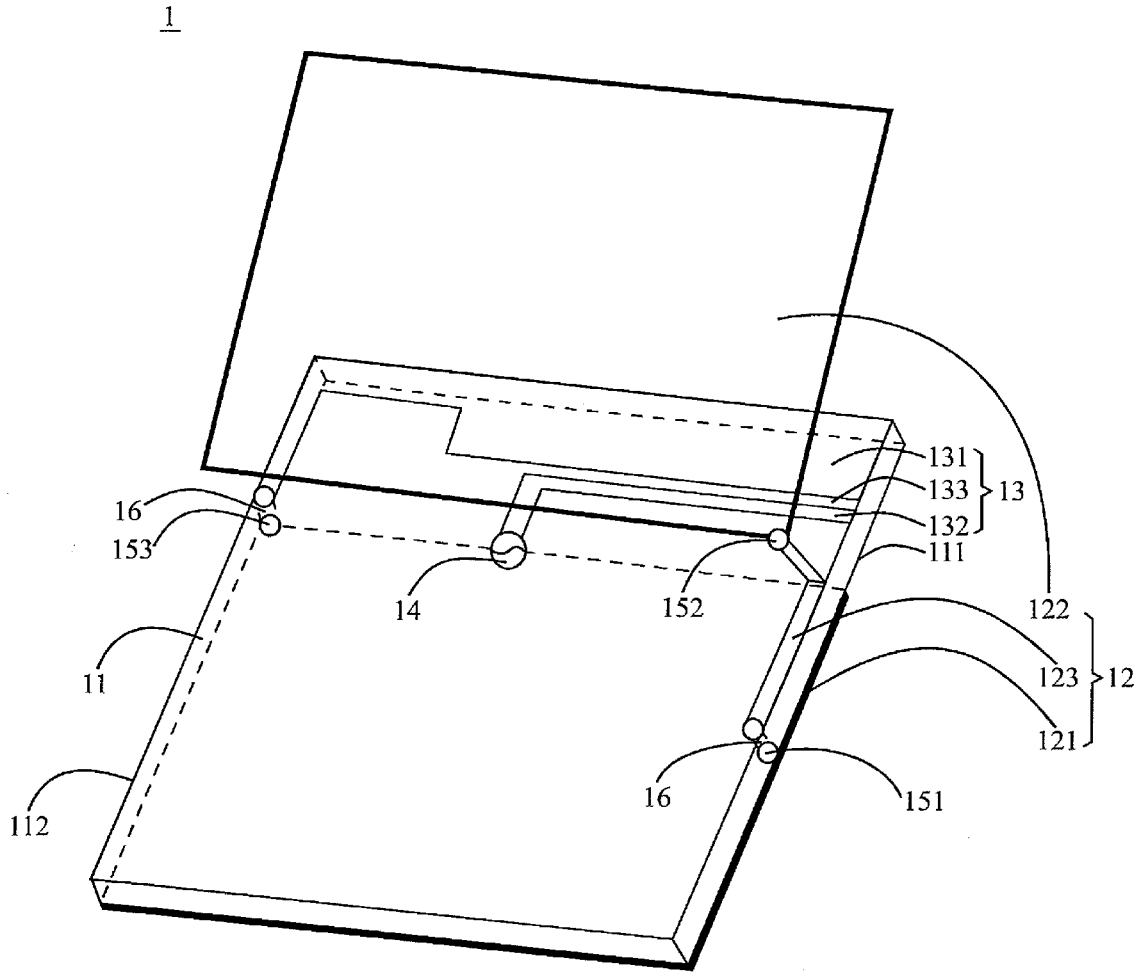
FIG. 2 illustrates a structural view of the multiband antenna in a first embodiment of the present invention.
Figure 3:
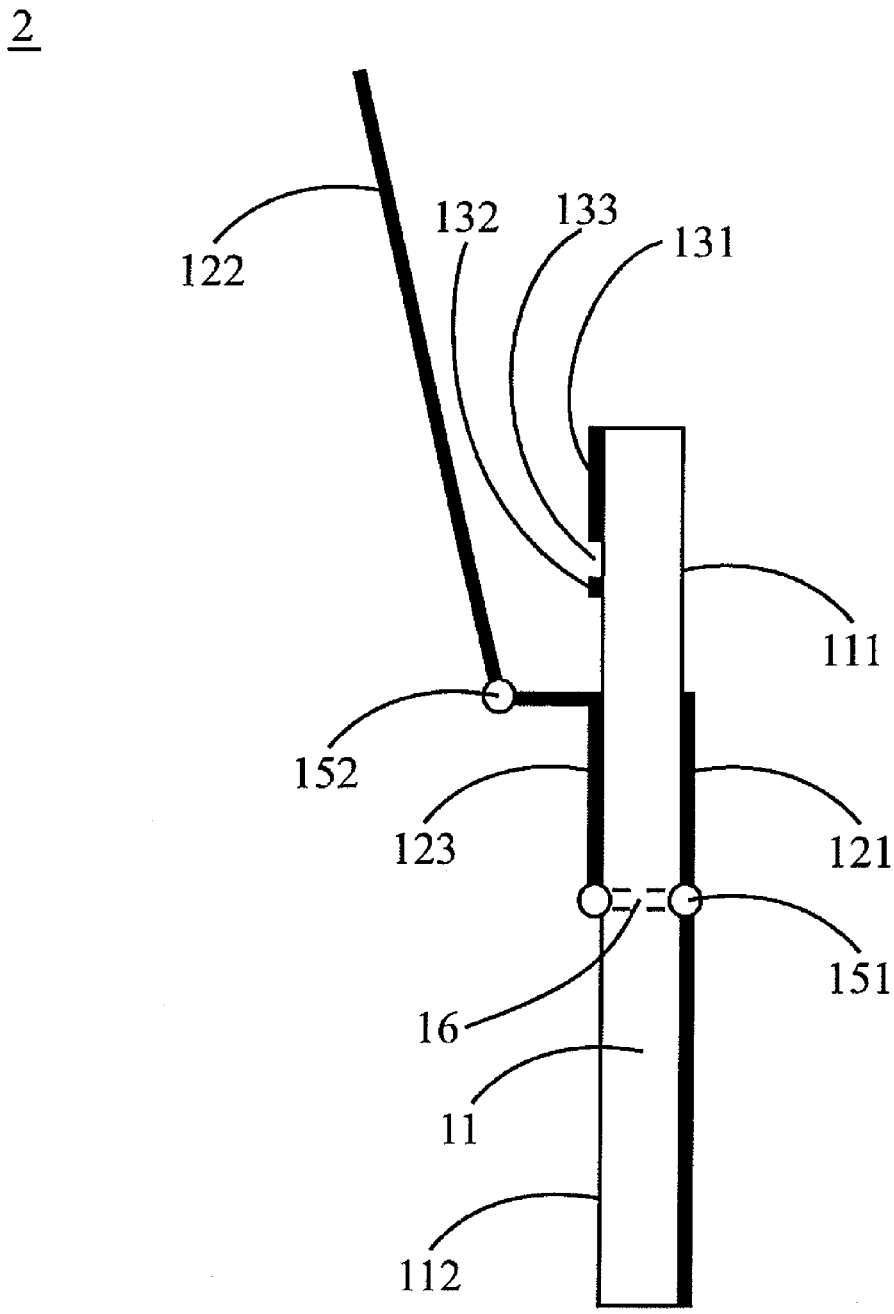
FIG. 3 illustrates a side view of the multiband antenna in the first embodiment of the present invention when the cover of the communication device is open.
Figure 4:
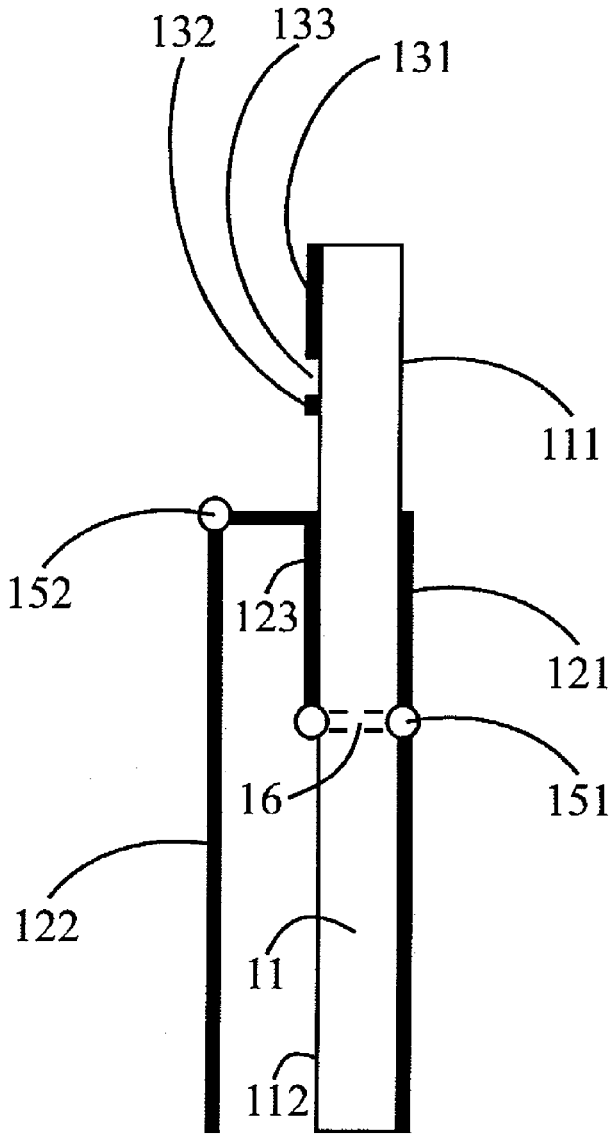
FIG. 4 illustrates a side view of the multiband antenna in the first embodiment of the present invention when the cover of the communication device is closed.

Please refer to FIG. 1 to FIG. 4. FIG. 1 illustrates a view of a communication device in an embodiment of the present invention; FIG. 2 illustrates a structural view of the multiband antenna in a first embodiment of the present invention; FIG. 3 illustrates a side view of the multiband antenna in the first embodiment of the present invention when the cover of the communication device is open; and FIG. 4 illustrates a side view of the multiband antenna in the first embodiment of the present invention when the cover of the communication device is closed.

The present invention discloses a communication device 100 comprising a multiband antenna 1. The communication device 100 is basically in either an open (the talk condition) state (as shown in FIG. 1) or a closed (the idle condition) state. When the communication device 100 has different opening angles, the multiband antenna 1 has different opening angles accordingly. The multiband antenna 1 provides good signal transmitting/receiving functions regardless of the opening angles. In the embodiment, the communication device 100 is a folder-type mobile phone, though the communication device 100 is not limited thereto.

Please refer to FIG. 1 and FIG. 2. The multiband antenna 1 comprises a dielectric substrate 11, a ground portion 12, and a radiating metal portion 13. The ground portion 12 comprises a first ground plane 121, a second ground plane 122, and a connecting metal strip 123.

The dielectric substrate 11 comprises a first surface 111 and a second surface 112; the first surface 111 is opposite to the second surface 112. In this embodiment, the first ground plane 121 is on the first surface 111 of the dielectric substrate 11; the first ground plane 121 can be formed on the dielectric substrate 11 by printing or etching. For example, the dielectric substrate 11 can be a system circuit board of the portable communication device, and the first ground plane 121 can be a system ground plane of the portable communication device.

The first ground plane 121 of the ground portion 12 has a first connecting point 151 and a shorting point 153. The second ground plane 122 of the ground portion 12 is near the first ground plane 121, and the second ground plane 122 has a second connecting point 152. The second ground plane 122 is not in contact with the second surface 112 (as shown in FIG. 3). For example, the second ground plane 122 can be a metal supporting plate of a front cover of the folder-type communication device.

In this embodiment, the communication device is a folder-type mobile phone. When the cover of the mobile phone is in the open state (the talk condition), the second ground plane 122 is not parallel to the second surface 112 (as shown in FIG. 3), and the first ground plane 121 is not parallel to the second ground plane 122 either. When the cover of the mobile phone is in the closed state (the idle condition), the second ground plane 122 is parallel to the second surface 112, and the first ground plane 121 is parallel to the second ground plane 122 as well. The embodiment has taken into account the performance requirements of the antenna in non-parallel (the talk condition) and parallel (the idle condition) states and thus meets the requirements of practical applications.

It is noted that the first ground plane 121 and the second ground plane 122 can be disposed at other portions of the portable communication device. The first ground plane 121 and the second ground plane 122 can be disposed according to the mechanism design of the portable communication device. The embodiment can be modified and still achieve the required frequency band as long as it falls within the scope and the technological principles of the present invention. For example, the first ground plane 121 and the second ground plane 122 can be disposed at the same side of the dielectric substrate 11.

The connecting metal strip 123 and the first ground plane 121 are on different surfaces of the dielectric substrate 11. One end of the connecting metal strip 123 is connected to the first connecting point 151, the other end is connected to the second connecting point 152 through a via-hole 16. In this embodiment, one part of the connecting metal strip 123 is on the second surface 112 of the dielectric substrate 11, and the other part protrudes out of the second surface 112 and is suspended in the air with a bent shape to conform to the open/closed movements of the communication device (as in folder-type mobile phone). It is noted that the structure of the connecting metal strip 123 is not limited thereto.

In this embodiment, the radiating metal portion 13 is on one surface of the dielectric substrate 11 and is not overlapping with the first ground plane 121 in order to operate as a monopole or shorted monopole antenna; therefore, the quality factor of the antenna is decreased and the operating frequency band of the antenna is widened. For example, the radiating metal portion 13 could be formed on the dielectric substrate 11 by etching or printing.

The radiating metal portion 13 comprises a radiating section 131 and a feeding section 132. In this embodiment, the radiating section 131 and the feeding section 132 are on the same surface of the dielectric substrate 11. One end of the radiating section 131 is connected to the shorting point 153 through a via-hole 16, while the other end of the radiating section 131 is an open end.

One end of the feeding section 132 is connected to the signal source 14. In this embodiment, a microstrip feedline is used as an example. One end of the signal source 14 is connected to the first ground plane 121, and the other end of the signal source 14 is connected to the microstrip feedline. The other end of the feeding section 132 is an open end, where the open end of the feeding section 132 has a spacing 133 of less than 3 mm to the radiating section 131.

It is noted that the length of the spacing 133 is related to the capacitance that can be contributed to the antenna's input impedance; in addition, the total length of the spacing 133 is not necessarily parallel to the radiating section 131 and can be adjusted according to requirements.

Figure 5:
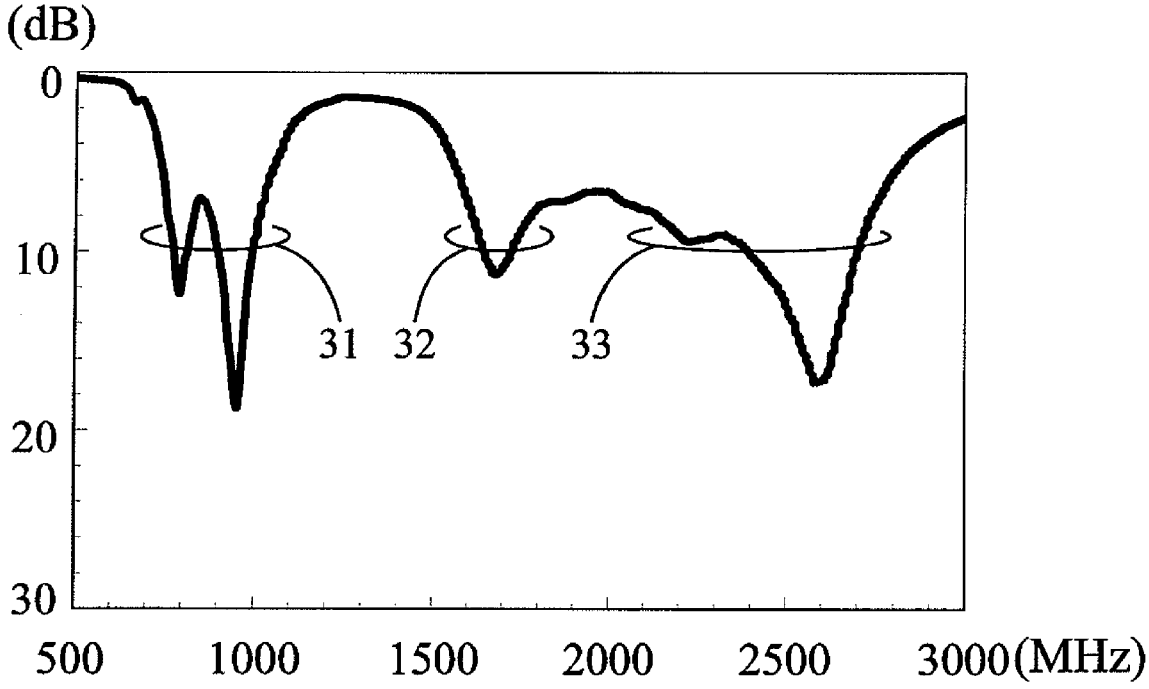
FIG. 5 illustrates a measured return loss of the multiband antenna in the first embodiment of the present invention.

FIG. 5 illustrates a measured return loss of the multiband antenna in the first embodiment of the present invention. In this embodiment, the parameters are chosen as follows: the length of the dielectric substrate 11 is about 110 mm, and the width of the dielectric substrate 11 is about 40 mm; the length of the first ground plane 121 of the ground portion 12 is about 100 mm, and the width is about 40 mm; the length of the second ground plane 122 is about 100 mm, and the width is about 40 mm; the length of the connecting metal strip 123 is about 40 mm, and the width is about 1 mm; and one part (about 35 mm in length) of the connecting metal strip 123 is on one surface of the dielectric substrate 11. The length of the radiating section 131 of the radiating metal portion 13 is about 50 mm; one end of the radiating section 131 is 2 mm wide, and the other end is an open end of about 5 mm in width. One end of the feeding section 132 is connected to the signal source 14 and has a width of about 2 mm, and the other end is an open end of about 1 mm in width. The open end of the feeding section 132 has a spacing of about 1.5 mm from the radiating section 131.

From the results of the embodiment, with the definition of 6-dB return loss, the first resonant mode 21 (dipole-like half-wavelength mode of the ground portion 12) is sufficient to cover the GSM850/900 bands, and the second resonant mode 22 (dipole-like one-wavelength mode of the ground portion 12) along with the third resonant mode 23 (quarter-wavelength mode of the multiband antenna 1 in the present invention) is sufficient to cover the GSM1800/1900/UMTS bands. Hence, the multiband antenna 1 of the present invention can provide multiband operations in the GSM850/900/1800/1900/UMTS bands to meet modern communication requirements.

Figure 6:
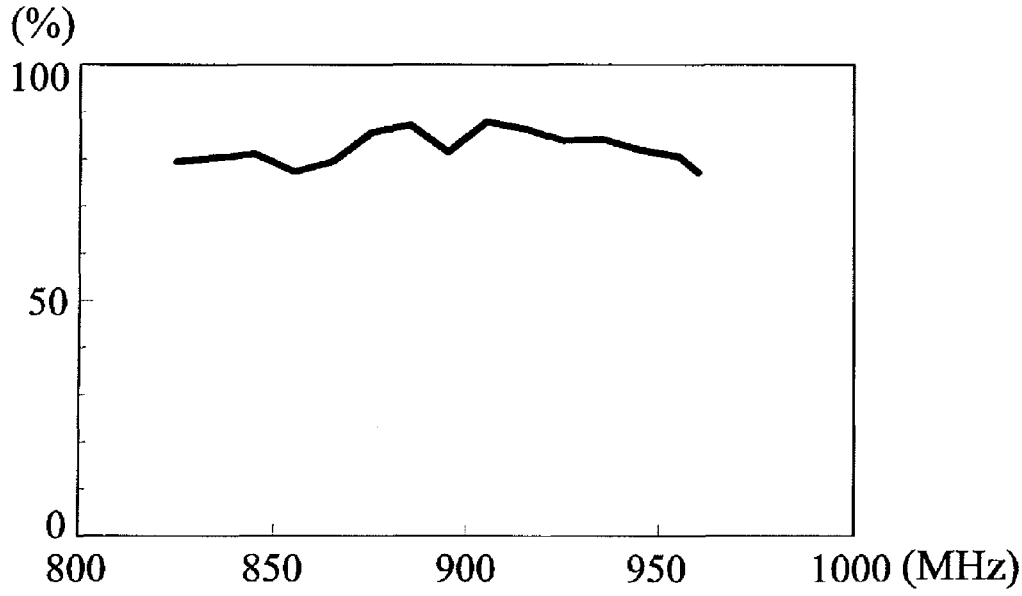
FIG. 6 illustrates a measured radiation efficiency of a low-frequency band of the multiband antenna in the first embodiment of the present invention.

FIG. 6 illustrates a measured radiation efficiency of a low-frequency band of the multiband antenna 1 in the first embodiment of the present invention. With the geometry described above, the multiband antenna 1 presents a radiation efficiency of higher than 80% in all operating bands and thus meets communication requirements.

Figure 7:
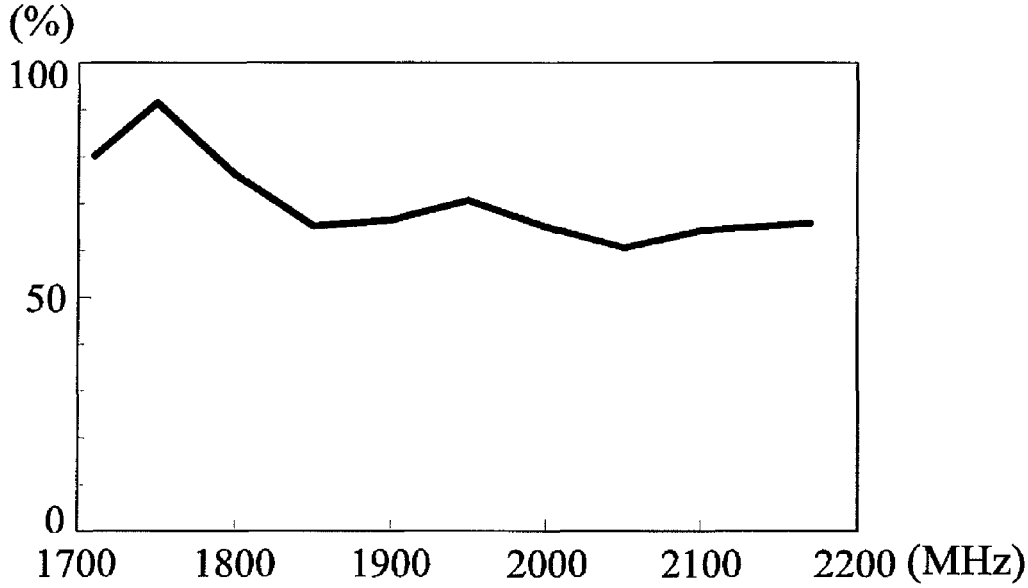
FIG. 7 illustrates a measured radiation efficiency of a high-frequency band of the multiband antenna in the first embodiment of the present invention.

FIG. 7 illustrates a measured radiation efficiency of a high-frequency band of the multiband antenna 1 in the first embodiment of the present invention. With the geometry described above, the multiband antenna 1 presents a radiation efficiency of higher than 60% in all operating bands and thus meets communication requirements.

Figure 8:
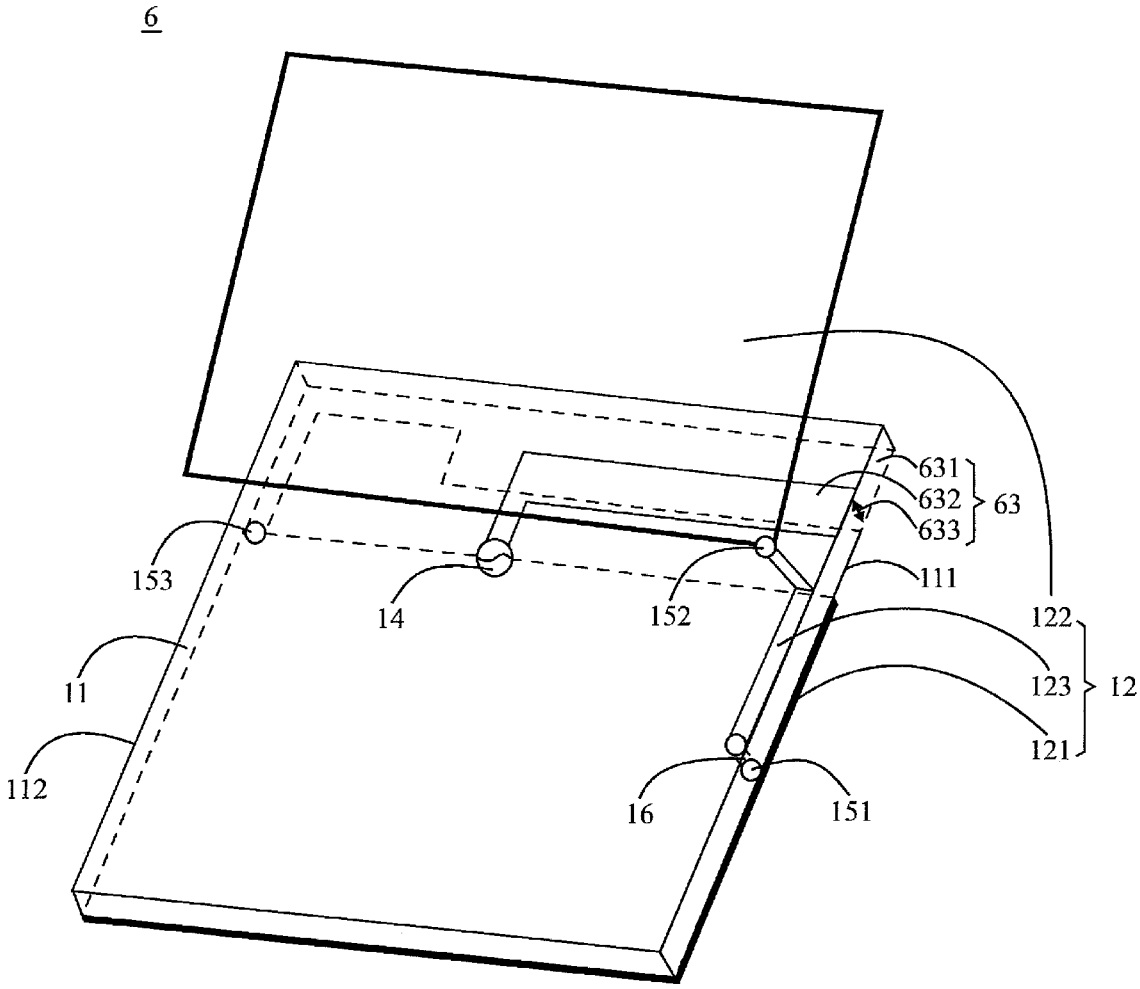
FIG. 8 illustrates a structural view of the multiband antenna in a second embodiment of the present invention.

FIG. 8 illustrates a structural view of a multiband antenna 6 in a second embodiment of the present invention. The multiband antenna 6 comprises a dielectric substrate 11, a ground portion 12, and a radiating metal portion 63. What is different from the first embodiment is that a radiating section 631 and a feeding section 632 of the multiband antenna 6 are on different surfaces of the dielectric substrate 11. Since the spacing 633 is determined by the thickness of the dielectric substrate 5, it follows that the thickness of the dielectric substrate 5 must be less than 3 mm. The operation principle of the second embodiment is the same as that of the first embodiment, and the second embodiment can achieve results similar to that of the first embodiment by adjusting the width of the open end of the feeding section 632 of the multiband antenna 6. Therefore, for the sake of brevity, it will not be described further.

As described, the multiband antenna of the present invention uses a specially designed connecting metal strip to effectively excite the dipole-like half-wavelength mode and one-wavelength mode of the communication device. By adjusting the length of the connecting metal strip, the surface current of the ground portion is modified to excite the one-wavelength mode, which is not available in the prior art technique, and the operating frequencies of the two resonant modes can be adjusted. In addition, by using the coupling feed technique and setting the spacing between the open end of the feeding section of the radiating metal portion and the radiating section at less than 3 mm to contribute additional capacitance for compensating for the large inductance, the two modes (half-wavelength and one-wavelength) of the ground portion are achieved with good impedance matching. The antenna itself is a coupled-fed inverted-F antenna and can operate in the quarter-wavelength mode to provide good impedance matching. Hence, the dipole-like half-wavelength mode of the ground portion can cover the GSM850/900 (low-frequency bands of the antenna) operations, and the dipole-like one-wavelength mode of the ground portion along with the quarter-wavelength mode of the coupled-fed inverted-F antenna can cover the GSM800/1900/UMTS (high-frequency bands of the antenna) operations. The multiband antenna of the present invention needs only to provide the resonant path for high-frequency operating bands; therefore, the occupied area of the multiband antenna is effectively reduced to achieve antenna miniaturization. Furthermore, the multiband antenna of the present invention can be manufactured with a simple process and low cost to meet practical application requirements.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A multiband antenna for a communication device, the multiband antenna comprising:

a dielectric substrate comprising two surfaces;

a ground portion comprising:

a first ground plane on one surface of the dielectric substrate, the first ground plane having a first connecting point and a shorting point;

a second ground plane near the first ground plane, the second ground plane having a second connecting point; and a connecting metal strip having one end connected to the first connecting point and another end connected to the second connecting point, with at least one part of the connecting metal strip on one surface of the dielectric substrate; and a radiating metal portion on one surface of the dielectric substrate, wherein the radiating metal portion is not overlapping the first ground plane, the radiating metal portion comprising:

a radiating section having one end connected to the shorting point and another end as an open end; and a feeding section having one end connected to a signal source and another end as an open end, wherein the open end of the feeding section has a spacing of less than 3 mm to the radiating portion.

2. The multiband antenna as claimed in claim 1, wherein the dielectric substrate is a system circuit board of a portable communication device.

3. The multiband antenna as claimed in claim 1, wherein the first ground plane is a system ground plane of a portable communication device.

4. The multiband antenna as claimed in claim 1, wherein the first ground plane and the radiating metal portion are formed on the dielectric substrate by etching or printing.

5. The multiband antenna as claimed in claim 1, wherein the second ground plane is a metal supporting plate of a front cover of a folder-type communication device.

6. The multiband antenna as claimed in claim 1, wherein the radiating section and the feeding section are on the same surface of the dielectric substrate.

7. The multiband antenna as claimed in claim 1, wherein the radiating section and the feeding section are on different surfaces of the dielectric substrate, respectively.

8. The multiband antenna as claimed in claim 1, wherein the dielectric substrate comprises a first surface and a second surface; the first ground plane is on the first surface, with at least one part of the connecting metal strip being on the second surface.

9. The multiband antenna as claimed in claim 8, wherein the radiating section and the feeding section are both on the second surface.

10. The multiband antenna as claimed in claim 8, wherein the radiating section is on the first surface and the feeding section is on the second surface.

11. The multiband antenna as claimed in claim 10, wherein the thickness of the dielectric substrate is less than 3 mm.

12. The multiband antenna as claimed in claim 1, wherein the first ground plane and the second ground plane are on opposite sides of the dielectric substrate.

13. The multiband antenna as claimed in claim 1, wherein the first ground plane and the second ground plane are on the same side of the dielectric substrate.

14. The multiband antenna as claimed in claim 1, wherein the first ground plane is not parallel to the second ground plane.

15. The multiband antenna as claimed in claim 1, wherein the communication device is a folder-type communication device.

16. A communication device comprising the multiband antenna as claimed in claim 1.

17. The communication device as claimed in claim 16, wherein the dielectric substrate comprises a first surface and a second surface; the first ground plane is on the first surface, with at least one part of the connecting metal strip being on the second surface.

18. The communication device as claimed in claim 17, wherein the radiating section and the feeding section are both on the second surface.

19. The communication device as claimed in claim 17, wherein the radiating section is on the first surface and the feeding section is on the second surface.

20. The communication device as claimed in claim 19, wherein the thickness of the dielectric substrate is less than 3 mm.

* * * * *